United States Patent [19]

Maitland

[11] Patent Number: 4,718,452

[45] Date of Patent: Jan. 12, 1988

[54] EMERGENCY POTABLE WATER STORAGE SYSTEM

[76] Inventor: Douglas W. Maitland, 13815 Loretta Drive, Santa Ana, Calif. 92705

[21] Appl. No.: 926,256

[22] Filed: Nov. 3, 1986

[51] Int. Cl.[4] ..... F03B 11/00

[52] U.S. Cl. ..... 137/592; 137/587

[58] Field of Search ..... 137/592, 587

[56] References Cited

U.S. PATENT DOCUMENTS

| | | | |
|---|---|---|---|
| 423,758 | 3/1890 | Goodbody | 137/592 |
| 2,123,809 | 7/1938 | Seitz | 137/592 |
| 2,602,465 | 7/1952 | Goehring | 137/582 |
| 2,931,382 | 4/1960 | Cirillo | 137/357 |
| 2,970,610 | 2/1961 | Johnston, Jr. | 137/592 |
| 2,971,532 | 2/1961 | McLaren et al. | 137/592 |
| 3,045,654 | 7/1962 | Dell | 137/592 |
| 3,095,893 | 7/1963 | Martin | 137/216 |
| 3,735,895 | 5/1973 | Roper | 220/63 |
| 3,874,544 | 4/1975 | Harmon | 220/3 |
| 4,003,399 | 1/1977 | Fischer | 137/592 |

*Primary Examiner*—A. Michael Chambers

*Attorney, Agent, or Firm*—Gausewitz, Carr & Rothenberg

[57] ABSTRACT

An emergency potable water supply system including a generally cylindrical water tank seated on a base member, with the tank having opposite dome-shaped portions. An inlet and discharge fitting is received in an opening in the uppermost part of the upper dome shaped portion, and a drain fitting is received in the lowermost part of the inverted dome-shaped bottom portion. All external connection fittings are conventional garden hose fittings, with the inlet fitting adapted for coupling, via a hose, to a standard exterior residential faucet. A check valve is provided at the inlet fitting, to serve as an anti-siphon valve in the event of a pressure drop at the inlet, and to serve as a vacuum release for discharge of the contents of the tank when needed. A garden hose is coupled to the outlet fitting for continual replenishment of the supply of water during use of the garden hose for normal tasks such as watering plants and shrubs.

18 Claims, 3 Drawing Figures

FIG. 1.
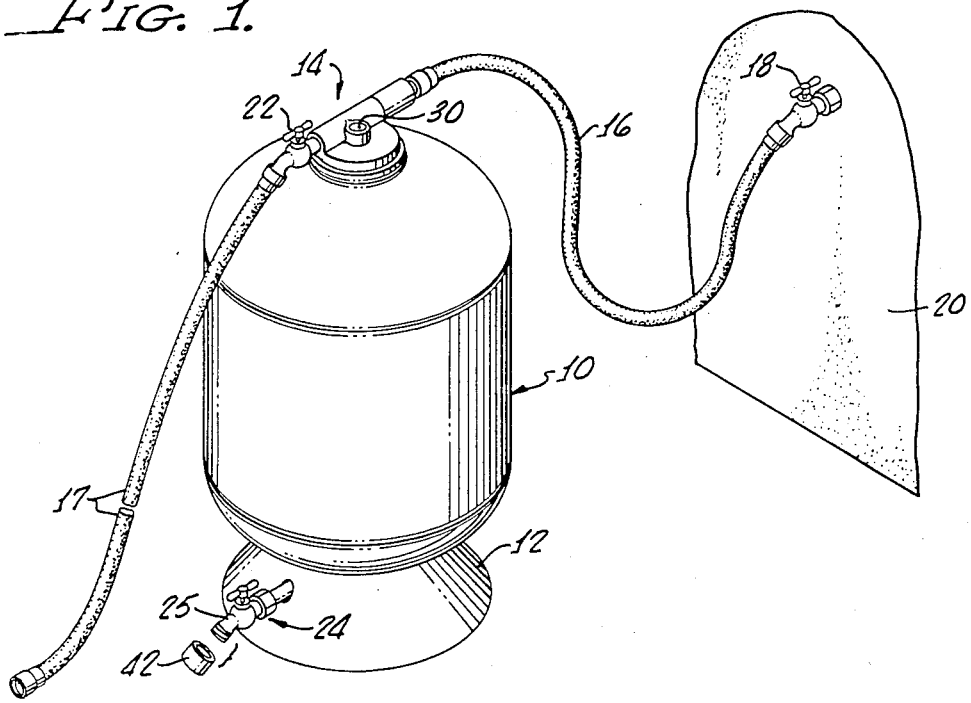
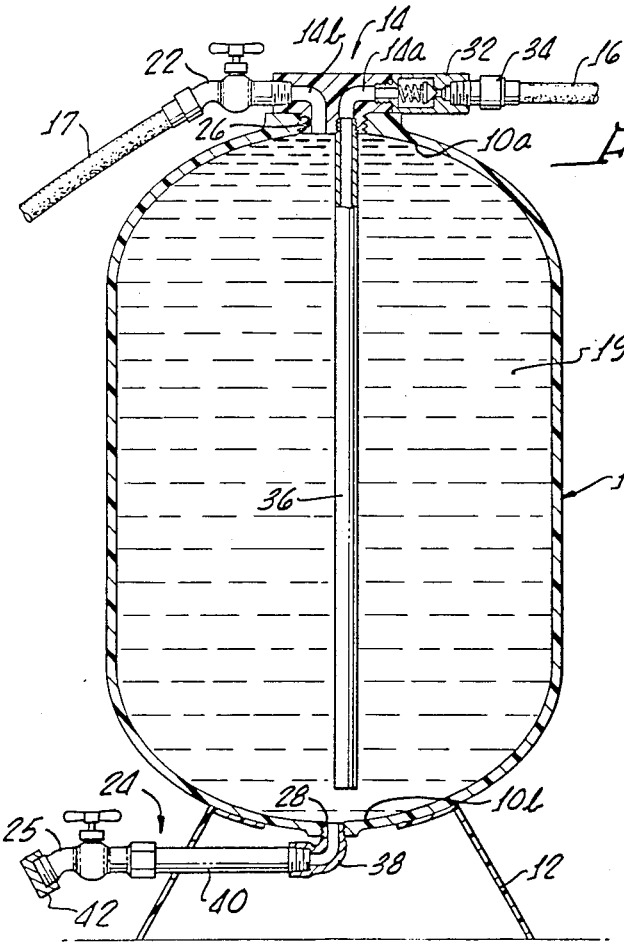
FIG. 2.
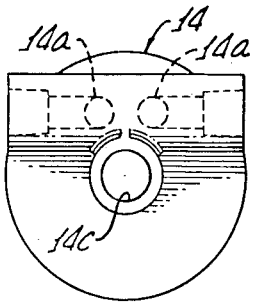
FIG. 3.

EMERGENCY POTABLE WATER STORAGE SYSTEM

BACKGROUND OF THE INVENTION

The background of the invention will be discussed in two parts.

Field of the Invention

This invention relates to emergency water storage systems, and more particularly to an emergency potable water storage system for ready attachment to a standard faucet on the outside of a dwelling.

Description of the Prior Art

In the event of an emergency, such as an earthquake or other catastrophic event, resulting in disruption of the normal municipal water supply, a fresh water supply is vital.

One such water supply system is shown and described in U.S. Pat. No. 2,931,382, entitled "Emergency Water Tank", which issued to Cirillo on Apr. 5, 1960. Another such water system is shown in U.S. Pat. No. 3,095,893, entitled "Emergency Water Storage Tank System for Use in Buildings", such patent being issued to Martin on July 2, 1963.

In both of such systems, the tanks are an integral part of the plumbing system, and are inline with the municipal water supply, with the interconnecting pipes being part of the normal plumbing, that is, rigid and inflexible. The tanks disclosed are either cylindrically or cubically configured. In both of such systems, with the tanks forming part of the structure, in the event of a natural disaster, such as an earthquake, the tanks, as well as the plumbing, are subject to the same structural weaknesses as the dwelling or building itself, that is, both the plumbing and the tanks can fracture or rupture under the stress of an earthquake. This is particularly so when the tank is supported by the beams of joists of the building, with a large volume of water contained therein. Additionally, with the disclosed systems, inlet and outlet fittings are disposed and arranged in such a manner that a large volume of air may be entrapped in the upper parts of the tanks of these systems, thereby providing a breeding ground for bacterial growth.

In any event, such in-building installations must meet building code requirements, with water storage within the structure itself creating need for additional bracing to withstand the added weight. By way of example, a relatively small fifty gallon tank of water would contain over 400 pounds of water in addition to the weight of the tank, and this weight would be distributed over a small base area, thus providing a pressure far in excess of normal household or office building furniture and the like. Furthermore, such systems do not enable the emergency water unit to be isolated as a self-contained water supply.

Other patents uncovered in a patent search include U.S. Pat. No. 2,970,610, entitled "Water Inlet Heat Tube", issued to Johnston, Jr. on Feb. 7, 1961, the patent being directed to a depending dip tube for coupling to the inlet of a hot water tank; U.S. Pat. No. 2,602,465, issued July 8, 1952, to Goehring for "Inlet Tube for Storage Tanks and the Like", the patent being directed to an inlet cylinder with vanes or louvers formed therein for causing incoming water to circulate in a manner so as not to disturb sludge or sediment found at the bottom of the tank; U.S. Pat. No. 2,971,532, entitled "Water Heater Fitting for Delivering Two Temperatures of Heated Water", issued on Feb. 14, 1961, to McLaren et al, and discloses a combination inlet-outlet fitting adapted to deliver two temperatures of heated water; U.S. Pat. No. 3,735,895, entitled "Composite Non-Sweat Water Tank", issued on May 29, 1973, to Roper, and discloses a water tank formed of a molded plastic with reinforcing strands, with a reflective exterior and air spaces provided interiorly to avoid sweating; and U.S. Pat. No. 3,874,544, entitled "Pressure Vessel with Liner", issued Apr. 1, 1975, to Harmon, such patent describing a pressure vessel formed of a composite material.

It is an object of the present invention to provide a new and improved emergency residential potable water supply.

SUMMARY OF THE INVENTION

In accordance with a preferred embodiment of the present invention, there is provided a generally cylindrical water tank seated on a base member, with the tank having opposite dome-shaped portions. An inlet and discharge fitting is received in an opening in the uppermost part of the upper dome shaped portion, and a drain fitting is received in the lowermost part of the inverted dome-shaped bottom portion. All fittings are configured for coupling to conventional garden hose fittings, with the inlet fitting adapted for coupling, via a garden, or high pressure hose, to a standard exterior residential faucet. A check valve is provided at the inlet fitting, to serve as an anti-siphon valve in the event of a pressure drop at the inlet, and to serve as a vacuum release for discharge of the contents of the tank when needed. A second garden hose is coupled to the outlet fitting for continual replenishment of the supply of water during use of the garden hose for normal tasks such as watering plants and shrubs.

The foregoing and other objects of the invention will become apparent from a reading of the specification, when taken in conjunction with the drawings, in which like reference numerals refer to like elements in the several views.

BRIEF DESCRIPTION OF THE DRAWINGS

FIG. 1 is a perspective view of the emergency water tank system connected to a building faucet in accordance with the invention;

FIG. 2 is a partially exploded cross-sectional view of the water tank of FIG. 1 as viewed along a vertical plane passing through the center thereof; and FIG. 3 is a top plan view of the fitting assembly used with the apparatus of FIGS. 1 and 2, with the plug removed.

DESCRIPTION OF THE PREFERRED EMBODIMENT

Referring now to the drawings, and particularly FIG. 1, there is shown an emergency potable water tank system in accordance with the invention, the system including a tank, generally designated 10, supported on the ground by a base 12, the tank 10 having an inlet/outlet fitting, generally designated 14, attached to the uppermost portion thereof, with a hose 16 attached between the fitting 14 and the conventional faucet 18 at the exterior wall 20 of a residential structure. Although hose 16 may be a conventional garden hose, a high pressure hose with conventional garden hose fittings is preferred. A second garden hose 17 is attached to a conventional manually operable valve, such as, faucet 22 coupled to the outlet end of fitting 14. Extending out from the base 12 is a drain fitting assembly, generally designated 24, which includes a conventional faucet 25.

As will become apparent, all of the connecting fittings are configured for attachment to hoses with conventional garden hose fittings, and the tank 10 is configured for withstanding the normal pressurization of a municipal water supply, normally less than 65 psi. The interior configuration of the tank 10, coupled with the location of inlet/outlet fitting 14, and drain fitting assembly 24, at the very top and very bottom of the tank 10, respectively, provides a system which requires virtual removal of all entrapped air during use of the second garden hose, thus providing a measure of security against bacterial contamination. Briefly, on original installation, hoses 16 and 17 are connected at the respective inlet and outlet ends of fitting 14, with hose 16 connected to faucet 18, which is then opened. The faucet 22 at the outlet of fitting 14 is opened and water flows into the tank 10 forcing the air out through faucet 22 until the tank is full, whereupon water flows through the hose 17 at municipal water pressure. Thereafter, the faucet 22 may be closed and used subsequently as one would normally use the faucet 18 at the wall of the residence. it is preferable that the hose 16 be a hose which will withstand pressures higher than some of the conventional garden hoses, and further it is preferred that the hose 16 have some resistance to photochemical decay due to the exterior environment. Since the wall faucet 18 is to remain open during use of the system, the hose 16 will thus be continually subjected to the residential water supply pressure.

By reference also to FIG. 2, the tank 10 is generally cylindrically configured with the top portion **10*a* being of a dome-shaped or upwardly oriented frusto-conical configuration. Similarly, the bottom portion 10*b* is somewhat of a mirror image of an inverted dome-shaped or inverted frusto-conical configuration. Coaxially aligned threaded openings 26 and 28 are formed in the uppermost and lowermost central portions of the top portion 10*a* and bottom portion 10*b*, respectively, the upper opening 26 being larger in diameter than the lower opening 28**.

The inlet/outlet manifold fitting 14 is threadably received within the opening 26, and includes a generally L-shaped inlet passage **14*a*, threaded at both ends, a generally L-shaped outlet passage 14*b*, likewise threaded at both ends, and a third vertically extending passage 14*c* threaded at the upper end thereof (See FIG. 3) which, in the instant embodiment is not used and is capped off by use of a threaded plug member 30. However, the tank passage 14*c*** may be readily used for other purposes, such as adding a second faucet type fitting or pressure relief valve.

A check valve member 32 is attached to the threaded opening of inlet passage **14*a*, with a coupler 34 at the other end thereof, the coupler 34 having a conventional female hose threaded opening. The check valve member 32 is arranged for allowing inflow of water through hose 16 coupled thereto, while closing when the municipal water supply pressure at faucet 18 drops, which would be indicative of a need for use of the emergency water supply within tank 10. At this point, the check valve member 32 acts as an anti-siphon valve. Although not shown, it is to be understood that a water filtration unit may be coupled in series with the check valve member 32**.

As also shown in FIG. 3, the passage **14*a* is generally L-shaped and the opening in the interior of tank 10 is likewise threaded, for receiving thereon a depending tube 36 having one end threaded, the lower end of which is in proximate relation to the bottom portion 10*a* of the tank 10. Passage 14*b* at the outlet end of the fitting 14 is likewise threaded for receiving the faucet 22** which is provided with a conventional male hose thread at the outlet end thereof.

The drain opening 28 is threaded and is located at the lowermost part of the bottom portion **10*b* of tank 10, this being the point where sludge and particulate matter will accumulate during use. Attached within the opening 28 is the drain fitting assembly 24, which includes an ell pipe member 38 with an extension pipe 40 coupled to the other end thereof, with faucet 25 coupled to the other end of pipe 40. As can be seen, the spacing above the ground provided by the base 12, coupled with the inverted frustoconical configuration of the bottom portion 10*b* enables the bottom portion to act as a collecting basin where particulate matter or sediment within the water gathers. Such matter may be readily removed by periodic opening of the drain faucet 25. Normally, the faucet 25 will be capped with a hose fitting cap member 42 to prevent bacterial invasion when not in use. During use, however, the cap 42 may be removed for attachment to the upper faucet 22**.

With the emergency potable water system as herein shown and described, the tank 10 on base 12 may be conveniently located exteriorly of a dwelling or structure occupied by human beings, to provide a measure of immunity to destruction or non-availability in the event of structural damage to the dwelling. The vessel or tank 10 may be readily fabricated in colors to provide an aesthetic appearance to the tank.

As previously briefly described, for use of the system, the hose 16 has one end thereof securely attached to the dwelling faucet 18 and the other end connectd to fitting 34. A second flexible garden hose is coupled to the outlet faucet 22. With the drain valve faucet 25 closed, and the outlet faucet 22 opened, the dwelling faucet 18 is then opened to permit the flow of water 19 through hose 18, through check valve member 32 through inlet passage **14*a* of fitting 14 into the interior of the tank 10. During the filling process, air from within the tank 10 is being expelled through the outlet passage 14*b*. Alternatively, the plug member 30 may be slightly removed, with faucet 22 closed during the fill process. In either event, as the water 19 level rises within the tank 10, with the sloping upper wall of the tank 10, and with the inlet fitting 34 and the outlet faucet 22 above the maximum water line of the tank 10, ultimately all of the air within the tank is expelled, thus leaving virtually no entrapped air. In the absence of air, bacterial formation within the tank 10** is inhibited.

Once the tank is filled, the plug member 30 or the outlet faucet 22 may then be closed. The wall faucet 18 may thereafter remain in its opened condition, whereupon the outlet faucet 22 is at municipal water pressure. Subsequently, the garden hose 17 is then used as one would conventionally use it for watering purposes. During each use of the hose 17 thereafter, the water 19 within the tank 10 is continually replenished with fresh water, with the depending tube 36 within the tank providing circulation of the water 19 and aertion in the process. Again, during each use, with the tank 10 configuration and with the inlet/outlet fitting 14 above the water line, all air is removed during the process. With the bottom portion 10b of the tank 10 configured as a sump or catch basin, particulate matter will accumulate adjacent the bottom opening 28, and may be periodically removed by opening the drain valve faucet 25.

In the event of a drop in the pressure of the municipal water supply, with the wall faucet 18 opened, the drop in pressure will activate the check valve member 32 to prevent siphoning of the water out of the tank 10. In such an event, the hose 16 is disconnected at the fitting 34, the cap 42 removed and placed on the faucet 22, and the drain faucet 25 is then used for releasing the water from within the tank 20 under the force of gravity. During this removal of the water, the check valve 32 admits air from the atmosphere, and thus acts as a vacuum release valve during this time.

In accordance with the present invention, there has been shown and described an emergency potable water supply system which is not connected within the dwelling, is not permanently affixed, and is located externally of the dwelling or structure for providing a readily available supply of water which is self-contained and isolated from the structure. By use of conventional garden hose fittings, the system may be readily assembled for use and relocation by a homeowner. The tank 10 may be of any suitable size such as fifty to one hundred gallons for providing an ample supply of fresh potable water in the event of failure of the municipal water supply.

While there has been shown and described a preferred embodiment, it is to be understood that various other adaptations and modifications may be mad within the spirit and scope of the invention.

What is claimed is:

1. An emergency potable water supply system for coupling to a faucet of a dwelling, the faucet being coupled for controlling the flow of water under pressure from a municipal water supply, said system comprising:

storage tank means for receiving water, said storage tank means including a tank having a frusto-conical configuration on the upper interior portion thereof;

water inlet means in flow communication with said tank means for connection to the faucet of the dwelling for introducing water into said tank means to a level to substantially fill said upper interior portion from the municipal water supply;

check valve means in series flow relation with said water inlet means;

first water outlet means in flow communication with the interior of said tank means, said first water outlet means being at a location above the highest level of water to be received within said tank means for enabling substantial replenishment of the water therein when discharging water therefrom under pressure fromsaid municipal water supply;

manually operable valve means in fluid flow communication with said first water outlet means;

second water outlet means in flow communication with the interior of said tank means, said second water outlet means being at a location at the lowest point of said tank means and having a manually operable valve means, said tank being substantially completely filled from the dwelling faucet, with loss of pressure of the municipal water source actuating said check valve means, with removal of the stored water being effected under force of gravity from said second water outlet means with said check valve means acting as a vacuum release during removal of the water when the water inlet means are disconnected from the dwelling faucet.

2. The system according to claim 1 wherein said tank has the bottom interior portion thereof configured to form a catch basin, and said second water outlet means includes a drain opening at the lowermost part of the catch basin.

3. The system according to claim 1 wherein the manually operable valve means of said first and second water outlet means are valves having discharge ends configured for coupling to a conventional garden hose.

4. The system according to claim 3 wherein said water inlet means includes garden hose fitting means for coupling to a hose.

5. The system according to claim 4 wherein said water inlet means further includes a tube member within said tank means in series flow relation with said check valve means.

6. The system according to claim 5 wherein said tube member is vertically arranged within said tank means and has a lower end terminating adjacent the bottom of said tank means.

7. The system according to claim 3 wherein said storage tank means is a tank having a frusto-conical configuration on the upper interior portion thereof.

8. The system according to claim 7 wherein said tank has the bottom interior portion thereof configured to form a catch basin, and said second water outlet means includes a drain opening at the lowermost part of the catch basin.

9. An exterior emergency potable water supply system for coupling to a faucet on the exterior of a dwelling, the faucet being coupled for controlling the flow of water under pressure from a municipal water supply, said system comprising:

a storage tank means for receiving water and being configured to provide basin means in the lower portion thereof, said storage tank means having a frusto-conical portion on the upper interior part thereof an upper opening at the uppermost part of said frusto-conical portion of said storage tank means;

a drain opening in said tank means at the lowermost part of said basin means;

a fitting assembly received within said upper opening, said fitting assembly including an inlet passage and an outlet passage above the level of water to be received within said tank means;

check valve means in series flow relation with said inlet passage;

hose fitting means in series flow relation with said check valve means and said inlet passage, said hose fitting means being adapted for coupling one end of a flexible hose thereto, with the other end of the hose connected to the dwelling faucet for introducing water into said tank means to a level substantially at the uppermost part of said frusto-conical portion from the municipal water supply;

second hose fitting means including a manually operable valve member coupled in series flow relation with said outlet passage for enabling substantial replenishment of the water therein when discharging water therefrom under pressure from said municipal water supply;

third hose fitting means including a manually operable valve member in series flow relation with said drain opening, said tank being filled from the dwelling faucet, with loss of pressure of the municipal water supply actuating said check valve means, with removal of the stored water being effected under force of gravity from said third hose fitting means with said check valve means acting as a vacuum release with the garden hose disconnected from the dwelling faucet.

10. The system according to claim 9 wherein said tank has the bottom interior portion thereof configured to form a catch basin, and said drain opening is at the lowermost part of the catch basin.

11. The system according to claim 9 wherein the manually operable valve members of the second and third hose fitting means are valves having discharge ends configured for coupling to a conventional garden hose.

12. The system according to claim 11 wherein the first hose fitting means includes means for coupling to a conventional garden hose.

13. The system according to claim 12 wherein said first hose fitting means further includes a tube member within said tank means in series flow relation with said check valve means.

14. The system according to claim 13 wherein said tube member is vertically arranged within said tank means and has a lower end terminating adjacent the bottom of said tank means.

15. The system according to claim 14 wherein said tank means has the bottom interior portion thereof configured to form a catch basin, and said drain opening is at the lowermost part of the catch basin.

16. An emergency potable water supply system for coupling to a hose faucet of a dwelling, the faucet being coupled for controlling the flow of water from a municipal water supply, said system comprising:

a storage tank for receiving water and having a frusto-conical configuration on the upper interior portion thereof, and the bottom interior portion thereof configured to form a catch basin;

an opening at the uppermost part of said frusto-conically configured portion of said tank;

a drain opening in said tank at the lowermost part of said catch basin portion;

a fitting assembly received within said upper opening, said fitting assembly including an inlet passage and an outlet passage above the level of water to be received within said tank;

check valve means in series flow relation with said inlet passage;

a tube member within said tank in series flow relation with said check valve means;

a first garden hose fitting in series flow relation with said check valve means and said inlet passage, said first hose fitting being adapted for coupling one end of a flexible hose thereto, with the other end of the hose connected to the dwelling faucet for introducing water into said tank means to a level substantially at the uppermost part of said frusto-conical portion from the municipal water supply;

a second garden hose fitting including a manually operable valve member coupled in series flow relation with said outlet passage for enabling substantial replenishment of the water in said tank when discharging water from said valve member under pressure from said municipal water supply;

a third garden hose fitting including a manually operable valve member in series flow relation with said drain opening, said tank being filled from the dwelling faucet, with loss of pressure of the municipal water supply actuating said check valve means, with removal of the stored water being effected under force of gravity from said third hose fitting means with said check valve means acting as a vacuum release with the garden hose disconnected from the dwelling faucet.

17. The system according to claim 16 wherein said tube member is vertically arranged within said tank means and has a lower end terminating adjacent the bottom of said tank means.

18. The system according to claim 17 wherein said storage tank is supported on a base.

* * * * *